US011459150B2

(12) United States Patent
Masukawa et al.

(10) Patent No.: US 11,459,150 B2
(45) Date of Patent: Oct. 4, 2022

(54) LIQUID REPLENISHMENT CONTAINER

(71) Applicant: CANON KABUSHIKI KAISHA, Tokyo (JP)

(72) Inventors: Tatsuya Masukawa, Kanagawa (JP); Manabu Otsuka, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/173,082

(22) Filed: Feb. 10, 2021

(65) Prior Publication Data

US 2021/0261301 A1 Aug. 26, 2021

(30) Foreign Application Priority Data

Feb. 20, 2020 (JP) ..... JP2020-026970

(51) Int. Cl.
*B41J 2/175* (2006.01)
*B65D 47/10* (2006.01)

(52) U.S. Cl.
CPC ..... *B65D 47/103* (2013.01); *B41J 2/1754* (2013.01); *B41J 2/17509* (2013.01); *B41J 2/17553* (2013.01); *B65D 2251/20* (2013.01)

(58) Field of Classification Search
CPC . B41J 2/14; B41J 2/175; B41J 2/17506; B41J 2/17509; B41J 2/17523; B41J 2/17596; B05B 1/28; B05B 1/326; B05B 9/0413; G03G 15/0886
See application file for complete search history.

(56) References Cited

U.S. PATENT DOCUMENTS 8,419,173 B2 * 4/2013 Hayashi ..... B41J 2/17523 347/85
9,315,034 B2 * 4/2016 Ono ..... B41J 2/1752
10,350,896 B2 7/2019 Ishizawa et al. .... B41J 2/17509
2012/0008882 A1 * 1/2012 Justice ..... B41J 2/175 383/43

FOREIGN PATENT DOCUMENTS

JP 2018-144281 9/2018

* cited by examiner

*Primary Examiner* — Anh T Vo
(74) *Attorney, Agent, or Firm* — Venable LLP

(57) ABSTRACT

The present invention provides a liquid replenishment container that replenishes a liquid tank including a liquid supply portion protruding in a first direction with a liquid. The container includes: a container main body capable of storing a liquid; a liquid replenishment nozzle including a first side wall and mountable on the liquid supply portion, the first side wall defining an internal space communicating with the container main body; and a valve body provided in the internal space and causing the liquid supply portion to communicate with the internal space when the liquid replenishment nozzle is mounted. The internal space has a first liquid replenishment flow path formed between the valve body and the first side wall and being constant in cross-section in the first direction, and a second liquid replenishment flow path formed inside the first liquid replenishment flow path and being continuous in the first direction.

19 Claims, 8 Drawing Sheets

LIQUID REPLENISHMENT CONTAINER

BACKGROUND OF THE INVENTION

Field of the Invention

The present invention relates to a liquid replenishment container.

Description of the Related Art

Ink replenishment containers for replenishing printers with ink are known. When in use, the ink replenishment container replenishes an ink tank having an ink outlet facing downward with ink. Since the ink replenishment container may take various postures when not in use, ink sealing property is required. Japanese Patent Application Laid-Open No. 2018-144281 discloses an ink replenishment container including a moving seal member that functions as a valve body. The moving seal member is housed in an ink outlet portion. The moving seal member is urged toward the tip end of the ink outlet portion by a spring member, and comes into contact with an outlet seal member provided on the inner wall surface of the ink outlet portion to seal an opening. When replenishing ink, a liquid supply portion of the printer is inserted into the ink outlet portion and pushes up the spring member. As a result, the moving seal member retracts and the opening is released from sealing. Ink is replenished to the printer through the opening by passing through an annular gap between the inner wall surface of the ink outlet portion and a moving seal portion.

SUMMARY OF THE INVENTION

According to the present invention, there is provided a liquid replenishment container for replenishing a liquid tank including a liquid supply portion protruding in a first direction with a liquid. The liquid replenishment container includes: a container main body capable of storing a liquid; a liquid replenishment nozzle that includes a first side wall and is mountable on the liquid supply portion, the first side wall defining an internal space communicating with the container main body; and a valve body that is provided in the internal space and causes the liquid supply portion to communicate with the internal space when the liquid replenishment nozzle is mounted. The internal space has a first liquid replenishment flow path that is formed between the valve body and the first side wall and is constant in cross-section in the first direction, and a second liquid replenishment flow path that is formed inside the first liquid replenishment flow path and is continuous in the first direction.

Further features of the present invention will become apparent from the following description of exemplary embodiments with reference to the attached drawings.

DESCRIPTION OF THE EMBODIMENTS

The ink replenishment container disclosed in Japanese Patent Application Laid-Open No. 2018-144281 has room for improvement in ink replenishment efficiency because an ink flow path is limited to the annular space between the inner wall surface of the ink outlet portion and the moving seal portion. This problem is common not only to the ink replenishment container for replenishing the printer with the ink, but also to a liquid replenishment container for replenishing the printer with a liquid other than the ink.

An object of the present invention is to provide a liquid replenishment container having improved liquid replenishment efficiency.

First Embodiment

Figure 1:
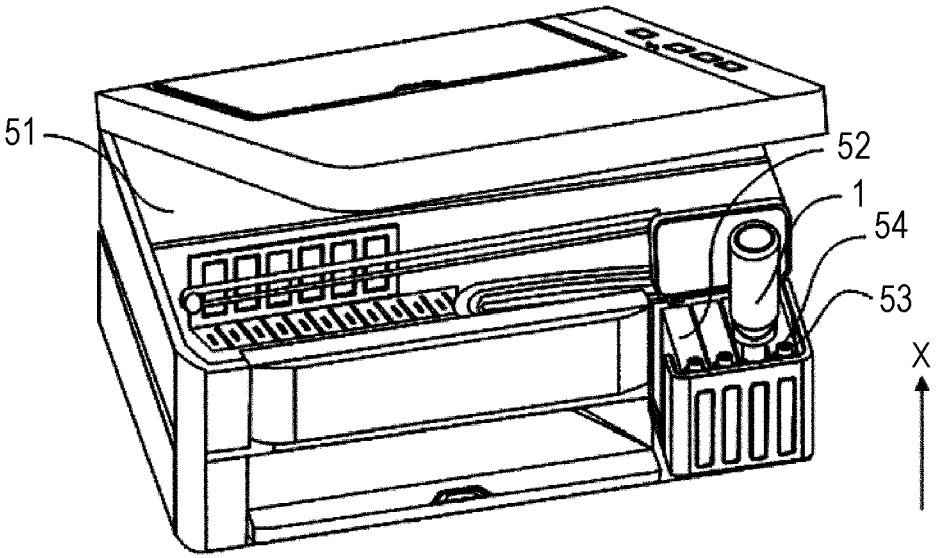
FIG. 1 is an external view of a printer used in combination with a liquid replenishment container of the present invention.

FIG. 1 is an external view of a printer 51 used in combination with a liquid replenishment container 1 of the present embodiment, and illustrates a state in which ink is replenished from the liquid replenishment container 1 to an ink tank 52 of the printer 51. The printer 51 includes a carriage (not illustrated) that can move in the scanning direction, and the carriage is provided with a recording head (not illustrated) that ejects ink onto a recording medium such as paper. A small-capacity tank (not illustrated) is placed on the carriage, and ink is supplied from the ink tank 52 via a tube (not illustrated). When the remaining amount of ink in the ink tank 52 decreases, ink is replenished from the liquid replenishment container 1. Therefore, the ink tank 52 includes a liquid supply portion 53 on which the liquid replenishment container 1 can be mounted. The liquid supply portion 53 is a protrusion provided on the upper surface of the ink tank 52 and protruding in a first direction X, and includes a liquid supply flow path 54 inside. When the liquid replenishment container 1 is mounted on the ink tank 52, the top of the liquid supply portion 53 comes into contact with an end surface 43 of a valve body 4, which will be described later, and the valve body 4 can be pushed up.

Figure 2A:
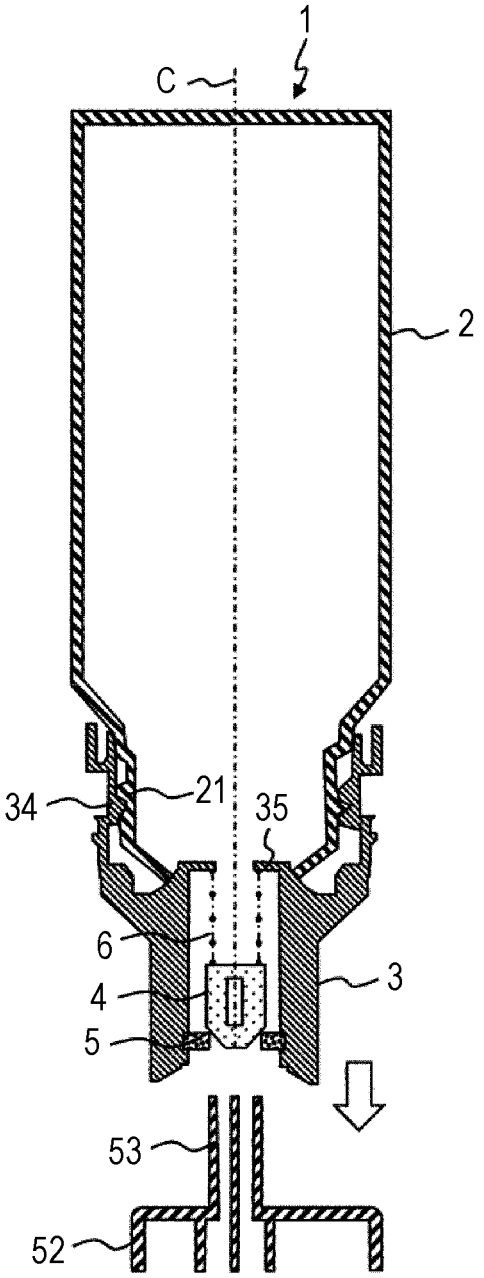
FIG. 2A is a cross-sectional view of a liquid replenishment container according to a first embodiment when it is not mounted.
Figure 2B:
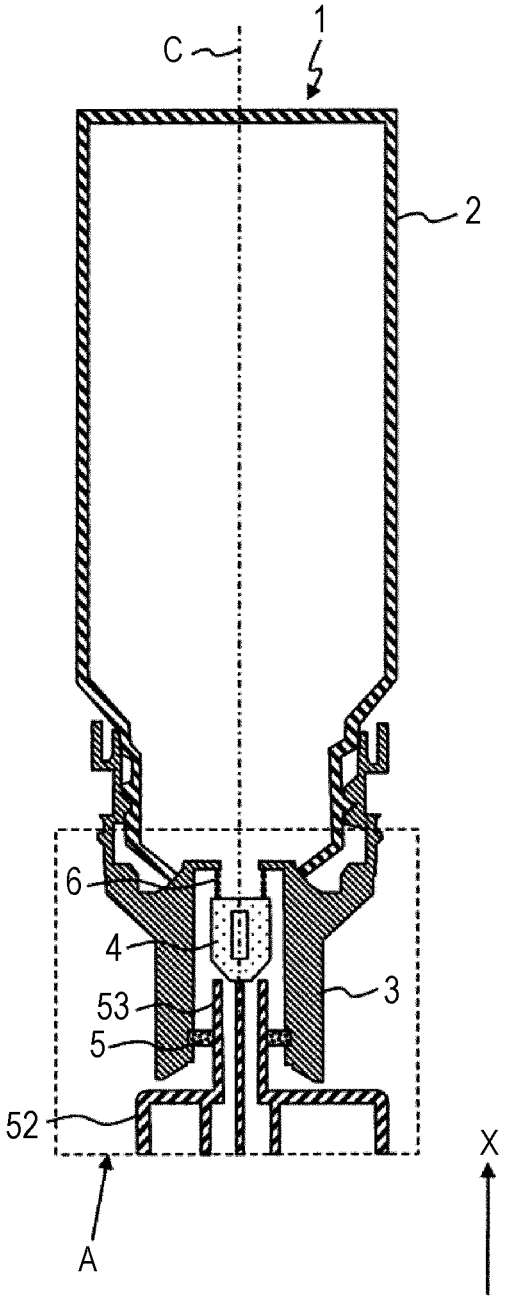
FIG. 2B is a cross-sectional view of the liquid replenishment container according to the first embodiment when it is mounted.

FIGS. 2A and 2B are cross-sectional views illustrating the overall configuration of the liquid replenishment container 1. FIG. 2A illustrates the liquid replenishment container 1 when it is not mounted on the ink tank 52 (hereinafter referred to as "when not mounted"), and FIG. 2B illustrates the liquid replenishment container 1 when it is mounted on the ink tank 52 (hereinafter referred to as "when mounted"). The liquid replenishment container 1 includes a container main body 2 capable of storing ink, and a liquid replenishment nozzle 3 mounted on the tip end of the container main body 2. The liquid replenishment container 1 has a longitudinal axis C parallel to the first direction X, and the liquid replenishment nozzle 3 extends from the end of the container main body 2 in the first direction X when mounted.

Figure 3A:
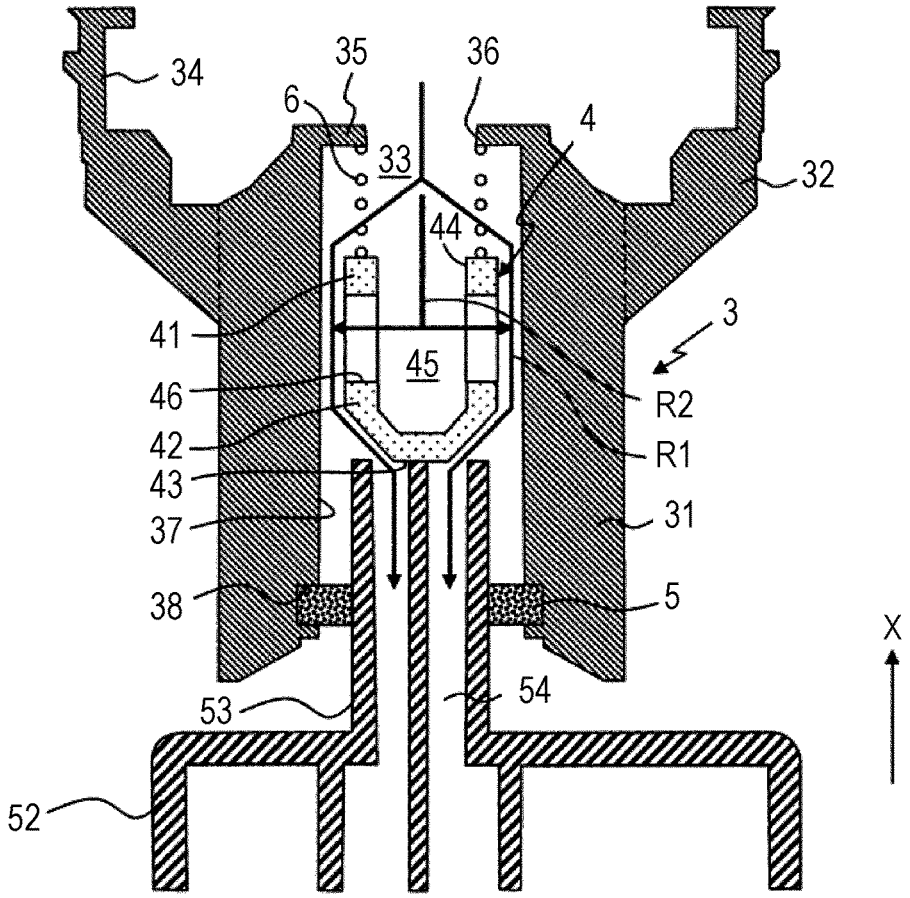
FIG. 3A is a partially enlarged view of the liquid replenishment container according to the first embodiment.
Figure 3B:
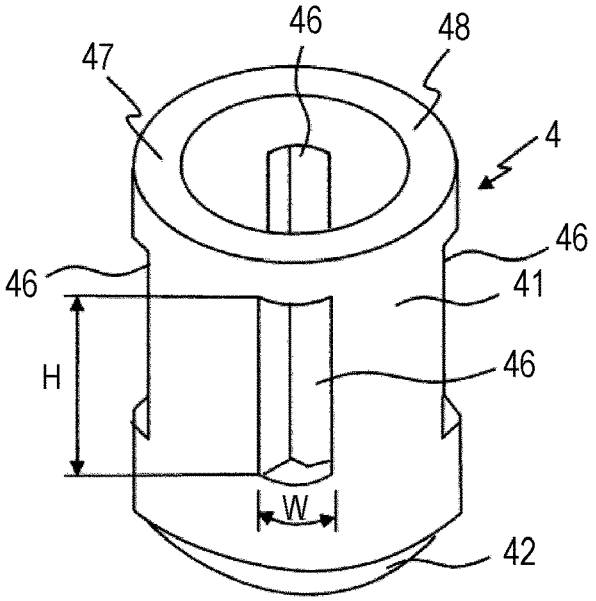
FIG. 3B is a perspective view of a valve body of the liquid replenishment container according to the first embodiment.

FIG. 3A is an enlarged view of part A of FIG. 2B, and FIG. 3B is a perspective view of the valve body 4. The liquid replenishment nozzle 3 includes a first side wall 31 and a joint portion 32 integrally formed with the first side wall 31. The first side wall 31 is a tubular body that defines a cylindrical internal space 33 communicating with the container main body 2. The joint portion 32 includes an engagement portion 34 that engages with a ridge portion 21 (see FIG. 2A) at the tip end portion of the container main body 2. An annular flange portion 35 projecting inward is provided at the end of the first side wall 31 on the container main body 2 side. An opening 36 serving as an ink flow path is formed inside the flange portion 35. A sealing material 5 projecting from the liquid replenishment nozzle 3 into the internal space 33 is provided at the end of the first side wall 31 on the ink tank 52 side. A groove 38 for holding the sealing material 5 is formed in the circumferential direction on an inner wall surface 37 of the first side wall 31 facing the internal space 33.

The valve body 4 is provided in the internal space 33. The valve body 4 has a substantially cylindrical outer shape having a long axis in the first direction X. Specifically, the valve body 4 includes a substantially cylindrical second side wall 41 and a truncated cone-shaped tip end portion 42 which is connected to the end of the second side wall 41 on the ink tank 52 side and of which the outer diameter decreases toward the tip end. The second side wall 41 forms an inner space 45 having an opening portion 44 on a surface 48 facing the container main body 2. The end surface 43 of the tip end portion 42 is a flat surface with which the tip end of the liquid supply portion 53 of the ink tank 52 abuts. The valve body 4 includes a plurality of (four in the present embodiment) through-holes 46 that penetrate the second side wall 41 and communicate with the inner space 45. The through-hole 46 causes the inner space 45 to communicate with a first liquid replenishment flow path R1 described later.

A spring member 6 is provided in the internal space 33. The spring member 6 is a coil spring, and urges the valve body 4 in the first direction X on the side opposite to the container main body 2. The spring member 6 is supported by an outer peripheral portion 47 provided on the surface 48 of the valve body 4 facing the container main body 2 and a flange portion 35 facing the outer peripheral portion 47. The valve body 4 is arranged substantially coaxially with the cylindrical internal space 33. As illustrated in FIG. 2A, when not mounted, the valve body 4 is moved to the tip end portion of the internal space 33 by the urging force of the spring member 6, and is in close contact with the sealing material 5. As a result, the outlet of the liquid replenishment container 1 is closed, so that ink leakage can be prevented even when the liquid replenishment container 1 is overturned or stored sideways.

As illustrated in FIG. 2B, when mounted, the liquid supply portion 53 of the ink tank 52 overcomes the urging force of the spring member 6 and is inserted into the internal space 33 of the liquid replenishment nozzle 3. The spring member 6 is compressed, and the valve body 4 is pushed up by the liquid supply portion 53 to separate from the sealing material 5. As a result, the outlet of the liquid replenishment container 1 is opened and ink can be supplied. That is, the valve body 4 moves in the first direction X when mounted to cause the liquid supply portion 53 to communicate with the internal space 33. At this time, since the liquid supply portion 53 is in close contact with the sealing material 5, it is possible to prevent ink leakage during ink filling. In this way, the sealing material 5 is in close contact with the valve body 4 when not mounted, and is in close contact with the liquid supply portion 53 when mounted to prevent ink leakage.

The liquid replenishment container 1 includes a first liquid replenishment flow path R1 and a second liquid replenishment flow path R2. The first liquid replenishment flow path R1 is formed between the valve body 4 and the first side wall 31, and is a flow path having a constant cross-section in the first direction X. The first liquid replenishment flow path R1 has a substantially annular flow path in a cross-section orthogonal to the first direction X, and this flow path is constant along the entire length of the second side wall 41 of the valve body 4 in the first direction X. The second liquid replenishment flow path R2 is formed inside the first liquid replenishment flow path R1 and extends continuously in the first direction X. This means that the shape of the second liquid replenishment flow path R2 extends continuously in the first direction X, and does not limit the direction in which the ink flows in the second liquid replenishment flow path R2. The second liquid replenishment flow path R2 is formed by the inner space 45 and at least one (four in the present embodiment) through-hole 46. The ink stored in the container main body 2 flows into the internal space 33 through the opening 36 inside the flange portion 35. Some ink flows through the first liquid replenishment flow path R1 between the valve body 4 and the first side wall 31. The remaining ink passes through the second liquid replenishment flow path R2, that is, the inner space 45 and the through-hole 46 of the valve body 4, and joins the first liquid replenishment flow path R1. The ink further flows through the first liquid replenishment flow path R1 and is supplied to the ink tank 52 through the gap between the tip end portion 42 of the valve body 4 and the liquid supply portion 53 of the ink tank 52.

Since the liquid replenishment container in the related art (hereinafter referred to as a comparative example) does not include the second liquid replenishment flow path R2, it is difficult to increase the ink flow rate. In the present embodiment, since the second liquid replenishment flow path R2 is provided substantially in parallel with the first liquid replenishment flow path R1, a length of the annular space between inner wall surface 37 of the first side wall 31 and the valve body 4 can be substantially shorten, hence resistance created between the ink and the annular space can be small. Accordingly, in the present embodiment, the ink flow rate supplied to the ink tank 52 can be increased as compared with the comparative example. Therefore, according to the present embodiment, it is possible to improve the replenishment efficiency of the ink supplied to the ink tank 52 and shorten the ink filling time.

The shapes of the inner space 45 and the through-hole 46 are not limited as long as the second liquid replenishment flow path R2 is formed, and may be any shape. For example, the shape of the cross-section of the inner space 45 perpendicular to the first direction X is not limited to a circle, but any shape such as a polygon such as a quadrangle, an ellipse, or a combination thereof can be used. The cross-sectional shape of the inner space 45 does not have to be constant in the first direction X, and may be, for example, a tapered shape in which the cross-sectional area decreases as the distance from the opening portion 44 increases. The shape of the through-hole 46 is also not limited. In the present embodiment, the through-hole 46 having a rectangular cross-section is provided, but the cross-sectional shape of the through-hole 46 may be a circle, a quadrangle, an ellipse, a square, or a combination thereof. The position of the through-hole 46 is also not limited, but the closer the through-hole 46 is to the ink tank 52, the shorter the ink flow path after the joining of the first liquid replenishment flow path R1 and the second liquid replenishment flow path R2, and the ink replenishment efficiency is improved. Therefore, the center of the through-hole 46 in the first direction X is preferably located closer to the tip end side of the liquid replenishment nozzle 3 than the center of the second side wall 41 in the first direction X. For the same reason, the shape of the through-hole 46 is preferably elongated in the first direction X, and more specifically, a maximum length H thereof in the first direction X is preferably larger than a maximum width W thereof in the circumferential direction of the second side wall 41. Although the number of through-holes 46 is not limited, it is preferable to provide the plurality of through-holes 46 evenly in the circumferential direction of the second side wall 41 in order to secure the strength of the valve body 4 and equalize the ink flow. In the present embodiment, four through-holes 46 are provided at intervals of 90 degrees. As the number of through-holes 46 increases, the opening ratio increases and the ink replenishment efficiency improves. However, the effect of the present invention can be achieved even if only one through-hole 46 is provided. The larger the opening ratio of the through-hole 46, the easier it is for ink to flow, but the strength of the valve body 4 decreases. Therefore, the opening ratio of the through-hole 46 is preferably 10% or more to 50% or less, and more preferably 10% or more to 30% or less. The opening ratio is the ratio of the total opening area of the through-hole 46 to the area of the outer peripheral surface (including the through-hole 46) of the second side wall 41.

Second Embodiment

Figure 4A:
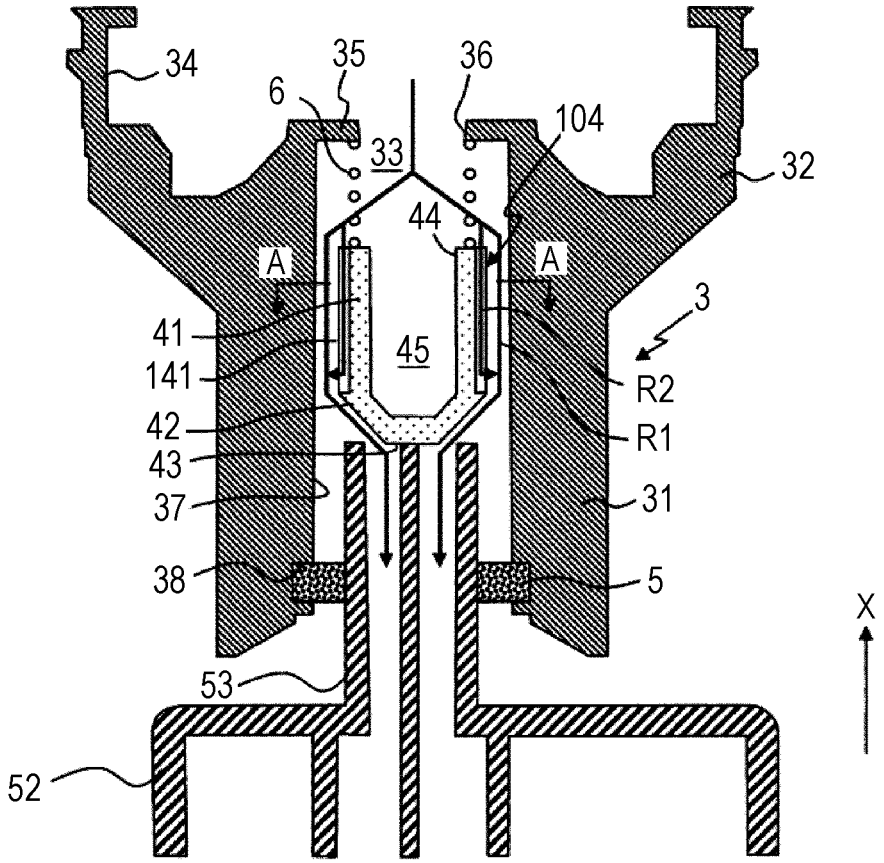
FIG. 4A is a partially enlarged view of a liquid replenishment container according to a second embodiment.
Figure 4B:
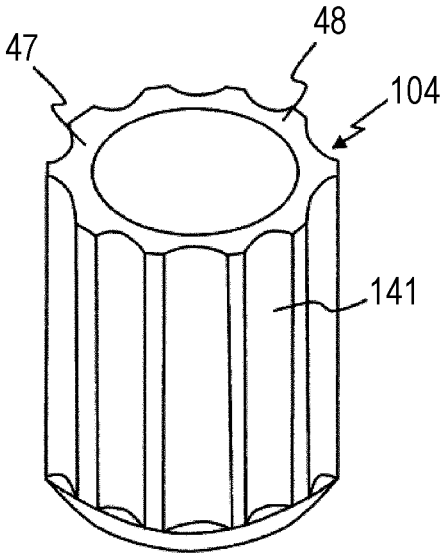
FIG. 4B is a perspective view of a valve body of the liquid replenishment container according to the second embodiment.
Figure 4C:
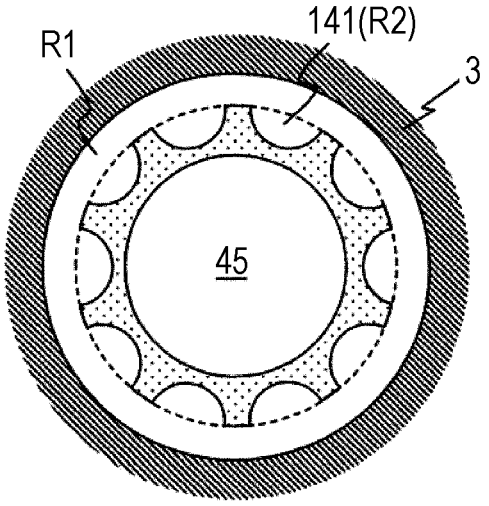
FIG. 4C is a cross-sectional view of the liquid replenishment container according to the second embodiment.

FIG. 4A is a view illustrating a liquid replenishment container 1 of a second embodiment, and FIG. 4A is a partially enlarged view of the liquid replenishment container and a perspective view of a valve body 104 as in FIGS. 3A and 3B. FIG. 4C is a cross-sectional view taken along the line A-A of FIG. 4A. The present embodiment is the same as the first embodiment except that a second liquid replenishment flow path R2 is a plurality of grooves 141 provided on the outer peripheral surface of the valve body 104. As illustrated in FIG. 4B, the plurality of grooves 141 extending in the first direction X are provided on the outer peripheral surface of a second side wall 41. The groove 141 extends over the entire length of the outer peripheral surface in the first direction X. Since the flow path cross-sectional area between a first side wall 31 and the valve body 104 increases over the entire length of the second side wall 41, the ink replenishment efficiency can be improved. A first liquid replenishment flow path R1 is formed between the envelope circle on the outer peripheral surface of the second side wall 41 of the valve body 104 and the first side wall 31. The groove 141 forms a second liquid replenishment flow path R2. In the present embodiment, the second liquid replenishment flow path R2 is provided inside the first liquid replenishment flow path R1 and is integrated with the first liquid replenishment flow path R1. The boundary between the first liquid replenishment flow path R1 and the second liquid replenishment flow path R2 is imaginary, and the ink does not branch and flow in the middle, but flows along one path.

The deeper the groove 141, the larger the cross-sectional area of the groove 141, and the ink replenishment efficiency can be improved, but this is disadvantageous from the viewpoint of the strength of the valve body 104. The ratio of the depth of the groove 141 to the thickness of the second side wall 41 is preferably 50% or more to 70% or less. The number of grooves 141 is not limited, and at least one groove 141 may be provided. However, as the number of grooves 141 increases, the total cross-sectional area of the grooves 141 increases, and the ink replenishment efficiency can be improved. On the other hand, when the range in which the groove 141 is formed is widened, it is substantially the same as the thickness of the second side wall 41 is reduced, and the strength may be insufficient. The ratio of the total width of the plurality of grooves 141 in the circumferential direction to the circumferential length of the envelope circle on the outer peripheral surface of the second side wall 41 is preferably 50% or more to 80% or less. In the present embodiment as well, the valve body 104 has an inner space 45, but unlike the first embodiment, the inner space 45 does not communicate with the first liquid replenishment flow path R1. The inner space 45 is preferably provided for weight reduction of the valve body 104, but may be omitted. That is, the valve body 104 may be a solid tubular body. In this case, since it is easy to secure the strength of the valve body 104, the depth of the groove 141 can be further increased.

Figure 5:
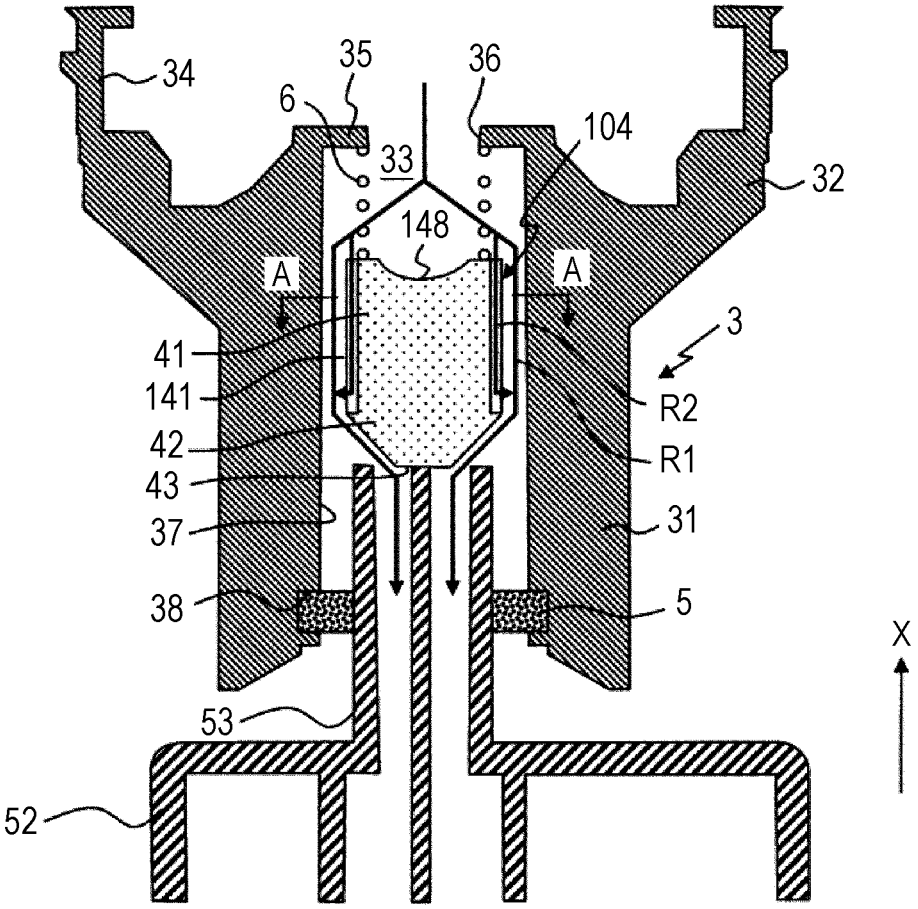
FIG. 5 is a partially enlarged view of the liquid replenishment container according to a modification example of the second embodiment.

As illustrated in a modification example of FIG. 5, while the valve body 104 has a solid structure, a recess 148 that opens on a surface 48 facing a container main body 2 and does not communicate with the first liquid replenishment flow path R1 may be formed. According to this modification example, since it is easy to secure the strength of the valve body 104, it is possible to reduce the weight of the valve body 104 while increasing the number and depth of the grooves 141.

Third Embodiment

Figure 6:
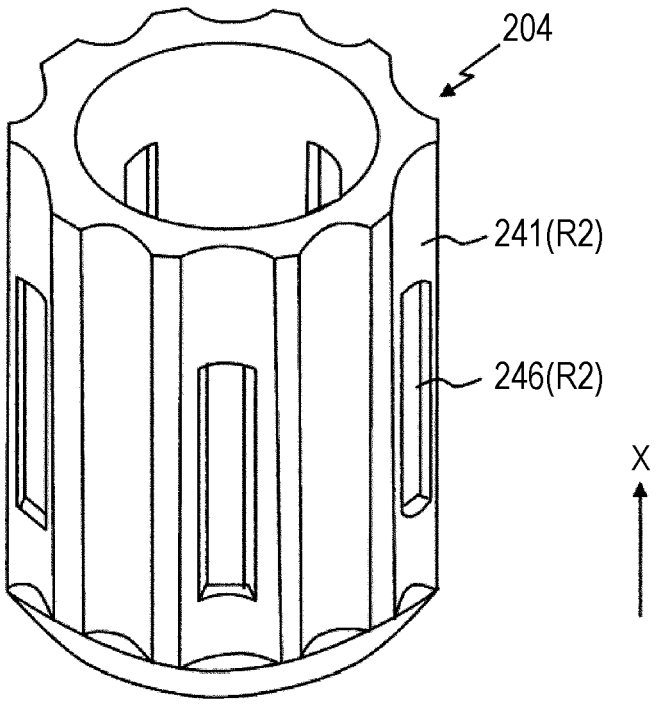
FIG. 6 is a perspective view of a valve body of a liquid replenishment container according to a third embodiment.

FIG. 6 is a view illustrating a valve body of a liquid replenishment container 1 of a third embodiment, and is a perspective view of a valve body 204 as in FIG. 3B. The valve body 204 of the present embodiment has the same configuration as the valve body 4 of the first embodiment except that a groove 241 similar to that of the second embodiment is provided. The valve body 204 includes at least one (10 in the present embodiment) groove 241 provided on the outer peripheral surface of the second side wall 41. The groove 241 extends in the first direction X and forms a part of the second liquid replenishment flow path R2. At least one (five in the present embodiment) through-hole 246 is provided in every other ten grooves 241. The configuration, number, arrangement, and the like of the grooves 241 are the same as those in the second embodiment. The present embodiment includes both the second liquid replenishment flow path R2 of the first embodiment and the second liquid replenishment flow path R2 of the second embodiment. Therefore, the ink replenishment efficiency of the second liquid replenishment flow path R2 is further improved.

Fourth Embodiment

Figure 7A:
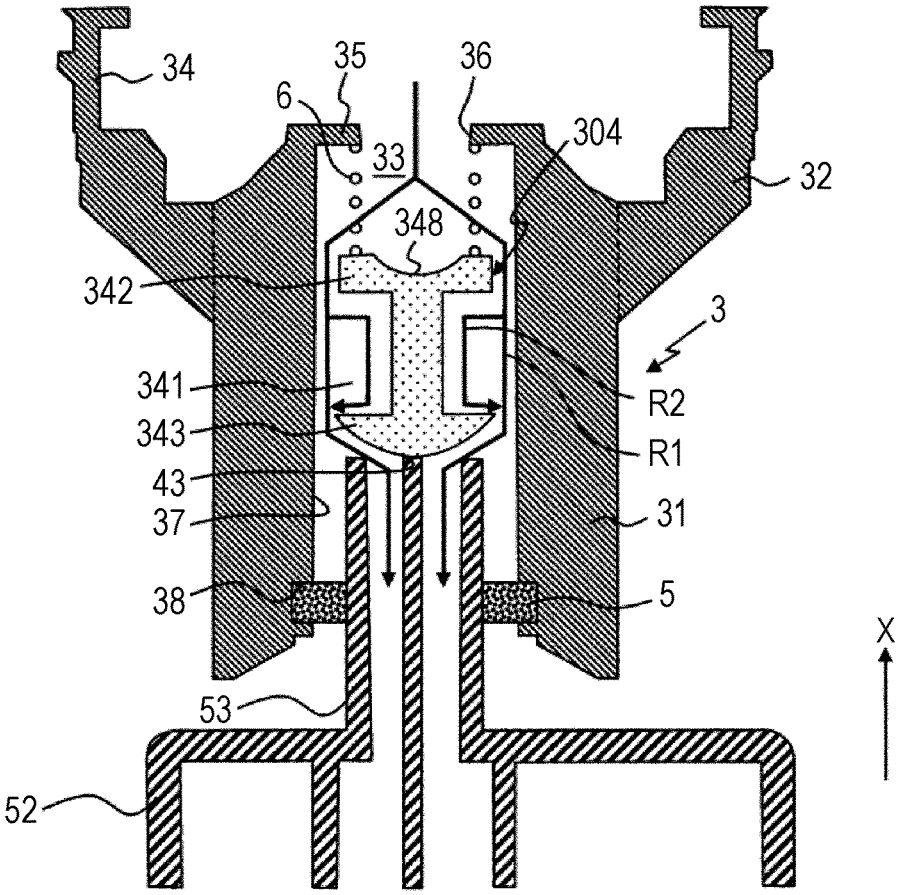
FIG. 7A is a partially enlarged view of a liquid replenishment container according to a fourth embodiment.
Figure 7B:
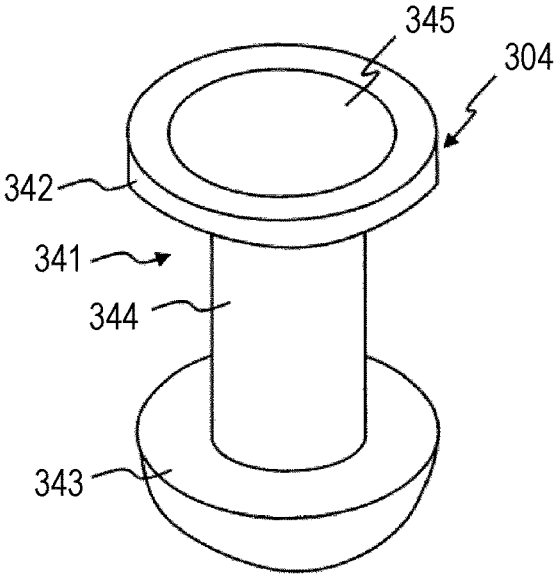
FIG. 7B is a perspective view of a valve body of the liquid replenishment container according to the fourth embodiment.

FIG. 7A is a view illustrating a liquid replenishment container 1 of a fourth embodiment, and FIG. 7B is a partially enlarged view of the liquid replenishment container and a perspective view of a valve body 304 as in FIGS. 3A and 3B. The present embodiment is the same as the first embodiment except that the configuration of the valve body 304 is different. The valve body 304 includes a circumferential recess 341 or a hollow in the intermediate portion in the first direction X. The circumferential recess 341 is a region that is provided over the entire circumference in the circumferential direction and drawn inward from both side ends, and forms a second liquid replenishment flow path R2. The valve body 304 includes a plate 342 facing a container main body 2, a tip end portion 343 located on the tip end side of a liquid replenishment nozzle 3 and a solid shaft 344 connecting the plate 342 and the tip end portion 343. The plate 342 has a circular shape. The shape of the tip end portion 343 is not limited as long as the central portion thereof protrudes toward the tip end side of the liquid replenishment nozzle 3, and can be, for example, a bowl-shaped shape as illustrated in the drawing or a truncated cone shape such as the tip end portion 42 of the first embodiment. The maximum diameter of the tip end portion 343 is larger than the inner diameter of a sealing material 5. Therefore, when not mounted, the circumferential side surface of the tip end portion 343 is in close contact with the sealing material 5 to prevent ink leakage. When mounted, a gap is formed between the circumferential side surface of the tip end portion 343 and a liquid supply portion 53, and an ink flow path is secured. The plate 342, the tip end portion 343 and the shaft 344 are integrally formed. The valve body 304 having such a configuration has a simple shape and is excellent in manufacturability. The second liquid replenishment flow path R2 is a space formed on the radial inside of the plate 342, the radial inside of the tip end portion 343 and the radial outside of the shaft 344. A recess 345 is formed on the upper surface of the plate 342 to reduce the weight of the valve body 304, but the recess 345 does not communicate with the circumferential recess 341. The recess 345 may be omitted.

Since the valve body 304 of the present embodiment does not have an inner space 45 unlike the first embodiment and the shaft 344 can have a solid structure, it is easy to secure the strength of the valve body 304. The ink passes through the gap between a first side wall 31 and the upper end portion (plate 342). Some ink flows further downward (that is, through the first liquid replenishment flow path R1). The remaining ink flows downward through the circumferential recess 341 (that is, flows through the second liquid replenishment flow path R2) and joins the first liquid replenishment flow path R1 near the lower end portion (tip end portion 343). As in the second embodiment, the first liquid replenishment flow path R1 and the second liquid replenishment flow path R2 are integrated flow paths. A connecting member that connects the plate 342 and the tip end portion 343 is not limited to the shaft 344, and various shapes can be used. For example, the connecting member may be one in which the outer diameter gradually decreases as the distance from the plate 342 increases, and the outer diameter gradually increases as the connecting member approaches the tip end portion 343. Alternatively, an R-shaped or C-shaped build-up portion may be provided at the connection portion between the shaft 344 and the plate 342 and the shaft 344 and the tip end portion 343.

Fifth Embodiment

Figure 8A:
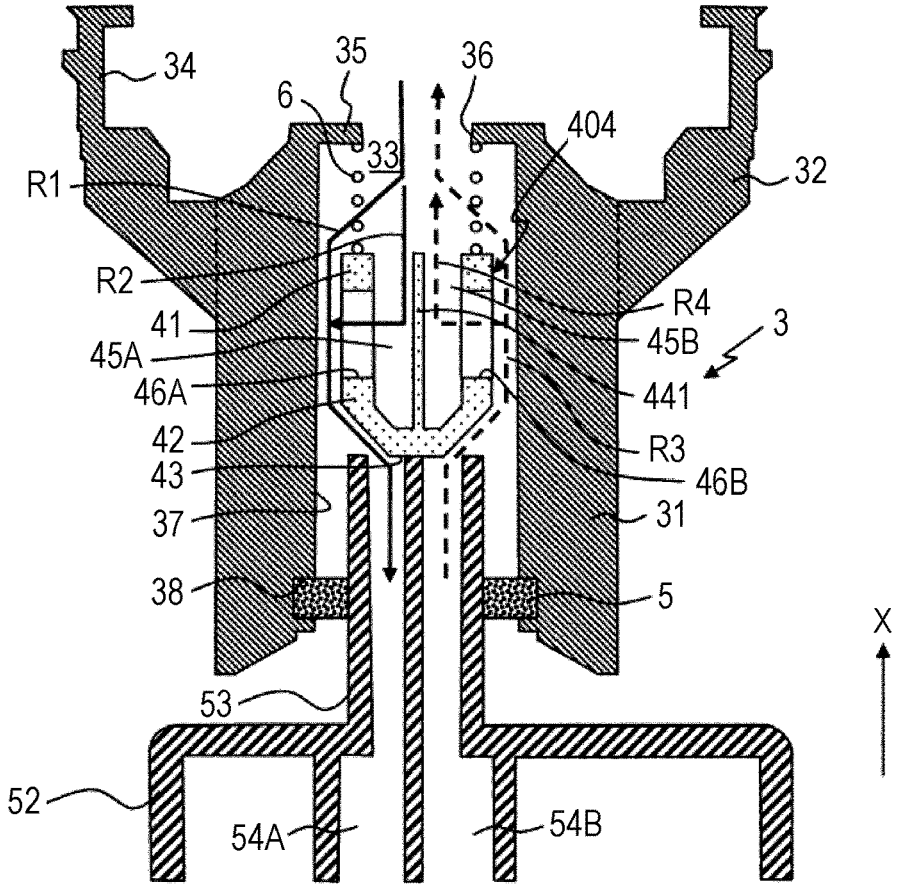
FIG. 8A is a partially enlarged view of a liquid replenishment container according to a fifth embodiment.
Figure 8B:
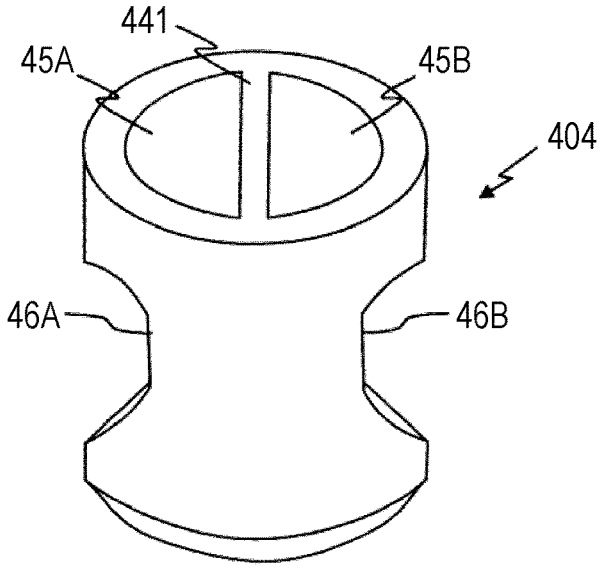
FIG. 8B is a perspective view of a valve body of the liquid replenishment container according to the fifth embodiment.

FIG. 8A is a view illustrating a liquid replenishment container 1 of a fifth embodiment, and FIG. 8B is a partially enlarged view of the liquid replenishment container and a perspective view of a valve body 404 as in FIGS. 3A and 3B. In FIG. 8A, the solid line shows the ink flow and the broken line shows the air flow. The present embodiment is the same as the first embodiment except that an inner space 45 inside the valve body 404 is divided into two regions 45A and 45B as illustrated in FIG. 8B. A liquid supply flow path 54 of an ink tank 52 is divided into an ink supply flow path 54A for supplying ink to the ink tank 52 and an air discharge flow path 54B for discharging air from the ink tank 52. The ink supply flow path 54A is connected to an ink supply pipe (not illustrated) extending to the bottom of the ink tank 52, and the air discharge flow path 54B is connected to an air discharge pipe (not illustrated) terminated at the upper portion of the ink tank 52. By supplying ink through the ink supply pipe while discharging the air from the ink tank 52 through the air discharge pipe, gas-liquid exchange inside the ink tank 52 can be smoothly performed, and the ink filling efficiency can be improved.

The inner space 45 is divided into the first region 45A and the second region 45B which are independent of each other by a partition plate 441. At least one through-hole 46 includes a first through-hole 46A communicating with the first region 45A and a second through-hole 46B communicating with the second region 45B. The first liquid replenishment flow path R1 is provided between the valve body 404 and the first side wall 31, and is a flow path having a constant cross-section in the first direction X. The second liquid replenishment flow path R2 is formed by the first region 45A and the first through-hole 46A. The ink is supplied to the ink tank 52 through the first liquid replenishment flow path R1 and the second liquid replenishment flow path R2. A part of the annular space between the valve body 404 and the first side wall 31 is a first air discharge flow path R3. A second air discharge flow path R4 is formed by the second region 45B and the second through-hole 46B. Air is discharged from the ink tank 52 through the first air discharge flow path R3 and the second air discharge flow path R4. The first region 45A and the second region 45B do not communicate with each other. The shape and number of the first region 45A and the second region 45B are not limited, but in order to improve the ink replenishment efficiency, the flow path cross-sectional area of the first region 45A is preferably larger than the flow path cross-sectional area of the second region 45B.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-026970, filed Feb. 20, 2020, which is hereby incorporated by reference herein in its entirety.

What is claimed is:

1. A liquid replenishment container for replenishing a liquid tank including a liquid supply portion protruding in a first direction with a liquid, the liquid replenishment container comprising:

a container main body capable of storing a liquid;

a liquid replenishment nozzle that includes a first side wall and is mountable on the liquid supply portion, the first side wall defining an internal space communicating with the container main body; and a valve body that is provided in the internal space and causes the liquid supply portion to communicate with the internal space when the liquid replenishment nozzle is mounted, wherein the internal space has a first liquid replenishment flow path that is formed between the valve body and the first side wall and is constant in cross-section in the first direction, and a second liquid replenishment flow path that is formed inside the first liquid replenishment flow path and is continuous in the first direction, wherein the valve body includes a second side wall forming an inner space that opens on a surface facing the container main body, and at least one through-hole that communicates with the internal space and penetrates the second side wall, and wherein at least a part of the second liquid replenishment flow path is formed by the inner space and the through-hole.

2. The liquid replenishment container according to claim 1, wherein a center of the through-hole in the first direction is located closer to a tip end side of the liquid replenishment nozzle than a center of the second side wall in the first direction.

3. The liquid replenishment container according to claim 1, wherein an opening ratio of the through-hole is 10% or more to 50% or less.

4. The liquid replenishment container according to claim 1, wherein the valve body includes a plurality of through-holes, and the plurality of through-holes are evenly arranged in a circumferential direction of the second side wall.

5. The liquid replenishment container according to claim 1, wherein the through-hole is elongated in the first direction.

6. The liquid replenishment container according to claim 1, wherein the valve body includes at least one groove that is provided on an outer peripheral surface of the valve body, extends in the first direction, and forms a part of the second liquid replenishment flow path, and the through-hole is provided in the groove.

7. The liquid replenishment container according to claim 1, wherein the inner space of the valve body is divided into a first region and a second region which are independent of each other, and the at least one through-hole includes a first through-hole communicating with the first region and a second through-hole communicating with the second region.

8. The liquid replenishment container according to claim 7, wherein the liquid is supplied from the first through-hole and air is discharged from the second through-hole.

9. The liquid replenishment container according to claim 8, wherein the first through-hole has a larger flow path cross-sectional area than the second through-hole.

10. The liquid replenishment container according to claim 1, wherein the valve body includes at least one groove that is provided on an outer peripheral surface of the valve body, extends in the first direction, and forms at least part of the second liquid replenishment flow path.

11. The liquid replenishment container according to claim 10, wherein the groove extends over an entire length of the outer peripheral surface in the first direction.

12. The liquid replenishment container according to claim 10, wherein the valve body includes a plurality of the grooves, and a ratio of a total width of the plurality of grooves to a circumferential length of the outer peripheral surface is 50% or more to 80% or less.

13. The liquid replenishment container according to claim 10, wherein the valve body includes a recess that opens on a surface facing the container main body and does not communicate with the first liquid replenishment flow path.

14. The liquid replenishment container according to claim 10, wherein the valve body includes a second side wall provided with the outer peripheral surface, and a ratio of a depth of the groove to a thickness of the second side wall is 50% or more to 70% or less.

15. The liquid replenishment container according to claim 1, wherein the valve body includes a circumferential recess that is provided over an entire circumference of an outer peripheral surface of the valve body, is drawn inward from both side ends in the first direction, and forms at least part of the second liquid replenishment flow path.

16. The liquid replenishment container according to claim 15, wherein the valve body includes a circular plate facing the container main body, a tip end portion located on a tip end side of the liquid replenishment nozzle and of which a central portion protrudes toward the tip end side, and a shaft connecting the plate and the tip end portion, and the circumferential recess is a space formed inside the plate and the tip end portion and outside the shaft.

17. The liquid replenishment container according to claim 16, wherein the shaft is solid.

18. The liquid replenishment container according to claim 1, further comprising:

a spring member that urges the valve body in the first direction, wherein the spring member is supported by an outer peripheral portion provided on a surface of the valve body facing the container main body and a flange portion provided on the liquid replenishment nozzle and facing the outer peripheral portion.

19. The liquid replenishment container according to claim 18, further comprising:

a sealing material that projects from the liquid replenishment nozzle into the internal space, wherein the sealing material is in close contact with the liquid supply portion when the liquid replenishment container is mounted on the liquid tank, and is in close contact with the valve body urged by the spring member when the liquid replenishment container is not mounted.

* * * * *